US009422077B2

(12) United States Patent
Malara

(10) Patent No.: US 9,422,077 B2
(45) Date of Patent: Aug. 23, 2016

(54) ADJUSTABLE VOLUME STORAGE CONTAINER

(71) Applicant: Fluke Corporation, Everett, WA (US)

(72) Inventor: Fabiano Malara, Den Haag (NL)

(73) Assignee: Fluke Corporation, Everett, WA (US)

( * ) Notice: Subject to any disclaimer, the term of this patent is extended or adjusted under 35 U.S.C. 154(b) by 0 days.

(21) Appl. No.: 14/474,081

(22) Filed: Aug. 29, 2014

(65) Prior Publication Data

US 2015/0060536 A1 Mar. 5, 2015

(30) Foreign Application Priority Data

Aug. 30, 2013 (EP) ..... 13004275

(51) Int. Cl.

| | |
|---|---|
| ***B65D 5/42*** | (2006.01) |
| ***B65D 21/08*** | (2006.01) |
| ***B65D 5/355*** | (2006.01) |
| ***B65D 5/32*** | (2006.01) |

(52) U.S. Cl.

CPC ..... *B65D 5/4279* (2013.01); *B65D 5/0005* (2013.01); *B65D 5/32* (2013.01); *B65D 21/086* (2013.01)

(58) Field of Classification Search

USPC ..... 229/122.23; 220/DIG. 25

See application file for complete search history.

(56) References Cited

U.S. PATENT DOCUMENTS

| | | | | |
|---|---|---|---|---|
| 1,654,225 | A * | 12/1927 | Tanner | 217/13 |
| 3,744,700 | A * | 7/1973 | Stegmann | 229/122.23 |
| 5,192,019 | A | 3/1993 | Meehan | |

FOREIGN PATENT DOCUMENTS

| | | | |
|---|---|---|---|
| DE | 200 00 367 | U1 | 5/2000 |
| EP | 0 268 541 | A1 | 5/1988 |
| GB | 614079 | A | 12/1948 |

OTHER PUBLICATIONS

European Search Report mailed Jan. 28, 2014, in European Patent Application No. 13004275.7, filed Aug. 30, 2013, 5 pages.

* cited by examiner

*Primary Examiner* — Christopher Demeree

(74) *Attorney, Agent, or Firm* — Seed IP Law Group PLLC

(57) ABSTRACT

A rectangular storage container comprises four parts, two of which are releasably coupled to each other to respectively form a bottom section and a top section such that, when assembled together, the bottom section and top section can move telescopically with respect to each other in a first dimension, and the respective two parts that are attached to form the bottom section and top section can additionally move with respect to each another in a second dimension, to enable adjustment of the volume of the storage container in two dimensions.

20 Claims, 7 Drawing Sheets

ADJUSTABLE VOLUME STORAGE CONTAINER

TECHNICAL FIELD

The present disclosure relates to the field of storage containers. In particular, the present disclosure relates to a storage container of adjustable volume.

BACKGROUND

Storage containers may be used for many purposes in order to protect the goods placed therein. This is particularly important for transporting goods securely to ensure no damage occurs during transport.

A problem with current storage containers used for transporting goods is that they are often only available in standard sizes, i.e., fixed dimensions corresponding to the various shipping costs charged by delivery companies, such as national post offices or courier firms. The goods that are to be transported are often much smaller than the standard sizes of storage container available, thereby leading to a high amount of unused space within the container. This in turn leads to the necessity to use further materials such as air pillows, paper, or other sorts of packing material to fill the unused space to protect the goods from possible damage caused by excessive pressure applied to the external walls of the container. The use of such packing materials is not only environmentally unfriendly due to the excess use of resources, but also cost intensive.

Furthermore, the shipping costs set by delivery companies are often based on both the actual weight of the storage container and goods in addition to the dimensional weight, i.e., taking into account the length, width, and height of the storage container to be transported.

Moreover, upon storage of such containers, a higher amount of space is taken up than necessary, which is often undesirable in storage premises where space may be limited.

SUMMARY

The present disclosure solves the aforementioned problem by providing a storage container of adjustable volume, a storage container part for forming a storage container of adjustable volume, and a blank for forming such a storage container or part.

In a first aspect of the present disclosure, a rectangular storage container is provided comprising four parts that are releasably coupled to each other. In the context of the present disclosure, the term "releasably coupled" means that each of the individual parts correspond with one another and may be assembled together without the need for further means of securing. For example, the individual parts may be arranged by being slotted together. The rectangular storage container is box-like, and each of the parts is substantially identical and effectively form a quarter of the entire structure of the storage container.

Specifically, when assembled, each of the parts comprise a base panel, two opposing panels, and a connecting panel joining the two opposing panels. According to the present disclosure, two of the parts are arranged, e.g., slotted together, to form a bottom section. In the context of the present disclosure, a bottom section is to be understood as constituting a container body or receptacle for receiving and storing goods. The bottom section comprises a base section and two opposing pairs of side walls defining an opening in the top of the bottom section. The remaining two parts are arranged to form a top section substantially identical to the bottom section comprising a lid section and two opposing pairs of side walls defining an opening at the bottom of the lid section. In the context of the present disclosure, the top section forms a container cover for the bottom section, but it will be understood by the skilled person that the terms "bottom" and "top" are relative, since both top and bottom sections are substantially identical.

When assembled together, the bottom section and top section can move telescopically with respect to each other in a first dimension, e.g., a vertical direction. Furthermore, the respective two parts that are arranged to form the bottom section and top section can additionally move with respect to each other in a second dimension, e.g., a horizontal direction, to enable adjustment of the volume of the storage container in both first and second dimensions.

The present disclosure thereby enables the volume of a storage container to be more flexibly adjusted to fit the goods inside the container. By virtue of the dimensions of the storage container more accurately corresponding to the dimensions of the goods stored therein, the present disclosure enables the advantageous saving of shipping costs due to a reduction in dimensional size and weight. Furthermore, the present disclosure minimizes the amount of extra packing material required, thereby further reducing the costs of shipping goods in a storage container. In addition, by reducing the dimensions of the storage container in this manner, the present disclosure also minimizes the carbon dioxide emissions caused by each shipment. Moreover, a storage container, according to the present disclosure, can be easily manufactured in any size or from any material, thereby introducing a great deal of flexibility in design.

In at least one embodiment, each of the parts are made from a piece of sheet material typically known as a blank or box blank. The sheet material is preferably cardboard or any other known material suitable for being cut and folded in order to manufacture and assemble a storage container. By manufacturing the parts from sheet material, the present disclosure provides a simple and convenient way of manufacturing and assembling a storage container. The sheet material merely needs to be marked, cut, and folded and can be manufactured with any dimensions, depending on the intended goods to be stored. Furthermore, since the parts of the storage container are flat prior to assembly, this facilitates storage and transport of the storage container itself.

In another embodiment, the first adjustable dimension of the storage container is the height, and the second dimension is the width. In contrast to known storage containers, by enabling the adjustment of two dimensions perpendicular to one another, one can not only adjust volume according to the height of the goods in container, but also according to the width.

According to another embodiment, the minimum width of the storage container corresponds to the maximum width of one of the two opposing side panels of an individual part. That is, the width of the side panels determines the minimum width of the storage container, since the opposing side panels form one of the pairs of opposite side walls of the bottom or top sections. Further, the maximum width of the storage container corresponds to the combined width of two side panels, each of the two side panels of a different one of the two parts arranged to respectively form the bottom or top section. In other words, since it is both of the opposing side panels from each of the two parts arranged as the bottom or top section that form one of the pairs of opposite side walls, it is the width of both that forms the maximum width of these side walls. This enables a high level of adjustment of volume through changing the width but without compromising strength of container walls. In particular, the width of the storage container may be increased to up to 50% of the width of a side panel.

In a further embodiment, the minimum height of the storage container corresponds to the maximum height of the two opposing side panels or connecting panel. That is, it is the height of the connecting panel that determines the minimum height of the storage container, as it is the connecting panels that form the other pair of two opposing side walls of the bottom or top section. Further, the maximum height of the storage container corresponds to at least 150% of the minimum height. In other words, since it is both of the connecting panels from each of the two parts arranged as the bottom or top section that form the other pair of opposite side walls, it is the height of both that forms the maximum height of these side walls. This enables a high level of adjustment of volume through changing the height but without compromising strength of the container walls. The storage container height may be increased up to 50% of the height of the connecting panel. However, it should be noted that extending the bottom and top sections to the limit of their telescopic movement will likely reduce the stability of the storage container.

In a further embodiment, the base panel comprises at least two portions foldably attached to the two opposing side panels. Preferably, the base panel of each part is formed by a plurality of portions of material, wherein at least one of the portions comprises a protruding tab with a notch, and one of the other panels, preferably the connecting panel, comprises at least one slit to receive the tab. The tab, notch, and slit arrangement functions as a locking mechanism when the tab is inserted into the slit, and the notch then prevents the tab from moving back through the slot. The skilled person will understand that a number of other such mechanisms may also be used for securing the panels together. These mechanisms facilitate assembly of the parts and storage container as well as security of the base panels that form the base and lid sections of the bottom and top sections.

In an embodiment, one of the two opposing panels has a smaller surface area than the surface area of the other, but not less than 50% smaller. By making one of the two opposing panels smaller than the other, less material is needed for the manufacture of each of the parts, thereby reducing costs, waste, and the overall weight of the storage container.

In a further embodiment, the base and/or lid sections preferably comprise at least two layers of material. Especially in embodiments where the base panel comprises at least two portions, this beneficially provides a more sturdy base and top of a container, regardless of the volume adjustment through changing, in particular, increasing, the width of the storage container. This is particularly advantageous as the base and lid sections are the areas most likely to be subject to pressure upon transport due to storage containers being stacked upon one another.

In a further embodiment, all four parts have substantially the same dimensions. This greatly facilitates manufacture and assembly, as the same design can be printed on, and cut from, a single sheet of material.

In another embodiment, at least one of the parts has different dimensions to the dimensions of the other parts. For example, two of the parts may have substantially identical dimensions to one another, but different to, e.g., slightly larger than, the dimensions of the other two parts. This enables the slightly larger parts to form, e.g., a top section that may be mounted over a bottom section formed from parts slightly smaller than those of the top section, thereby improving the telescopic movement of the sections with respect to each other.

In another aspect of the present disclosure, there is provided a storage container part comprising a base panel, two opposing panels, and a connecting panel joining the two opposing panels, wherein the part can be releasably coupled with three identical other parts to form a rectangular storage container as described in the embodiments above.

In a further aspect of the present disclosure, a blank of sheet material is provided for forming a storage container as described in the embodiments above.

DESCRIPTION OF THE DRAWINGS

Embodiments of the present disclosure will now be described in more detail, by way of example only, and with reference to the figures, in which.

DETAILED DESCRIPTION

Figure 1:
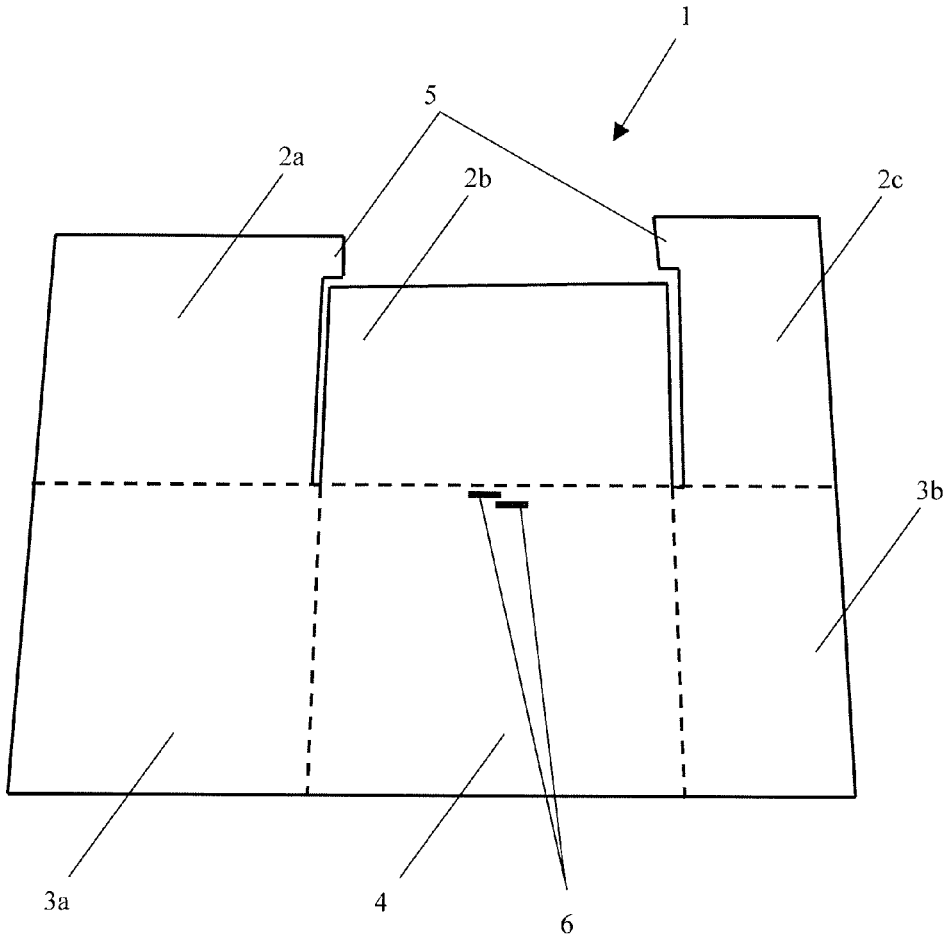
FIG. 1 shows the blank of a part for forming a storage container according to an embodiment of the present disclosure.

FIG. 1 shows a blank of a part 1 for forming a storage container part 1 according to an example of how to implement the present disclosure. The part has a base panel 2 comprising a plurality of panels 2*a-c* that are flaps foldably attached to two opposing side panels 3*a* and 3*b* and a connecting panel 4 that joins the two opposing side panels 3*a* and 3*b*. The part 1 is formed from a single piece of sheet material and the dotted lines indicate the parts of the blank that may be folded in order to form the storage container part.

Figure 2A:
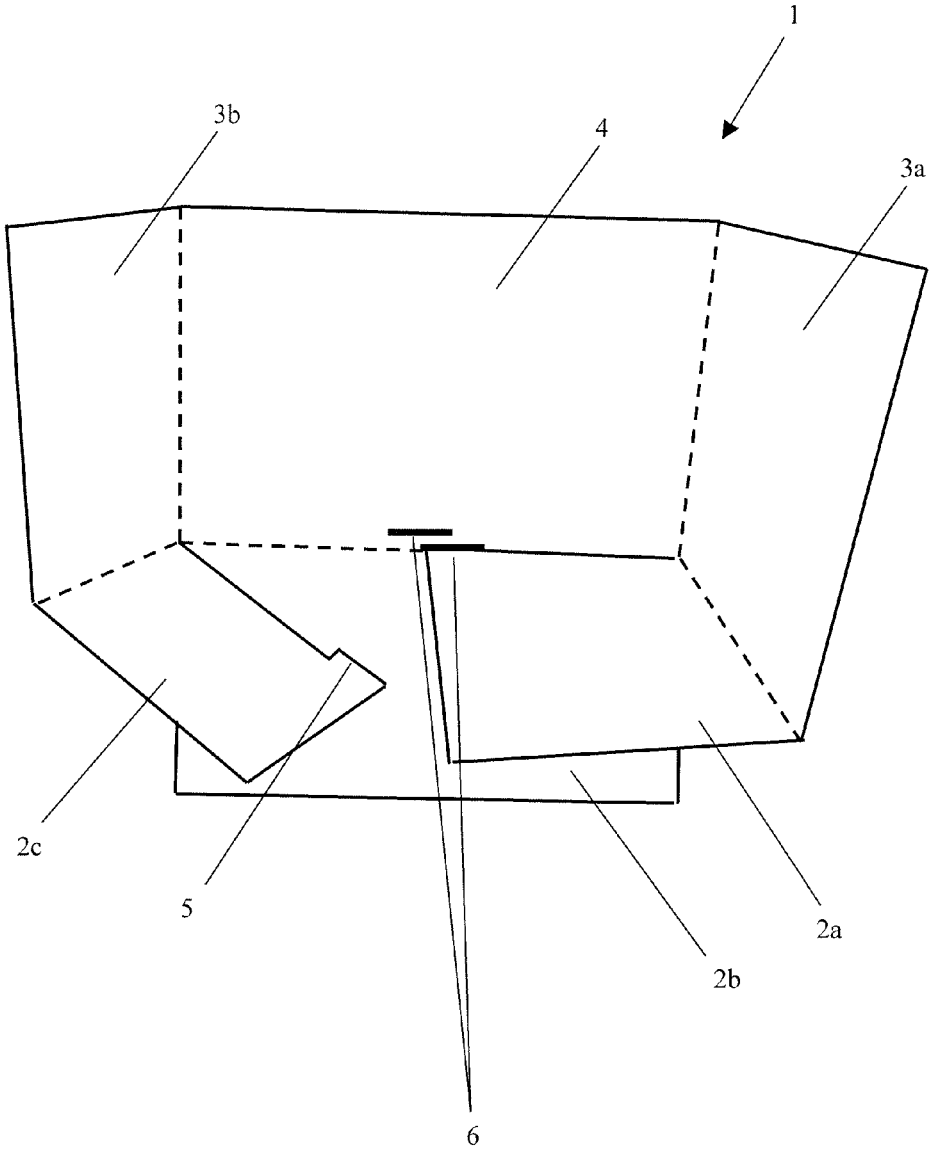
FIGS. 2A and 2B show the assembly of the blank of FIG. 1 in order to form a storage container part according to an embodiment of the present disclosure.
Figure 2B:
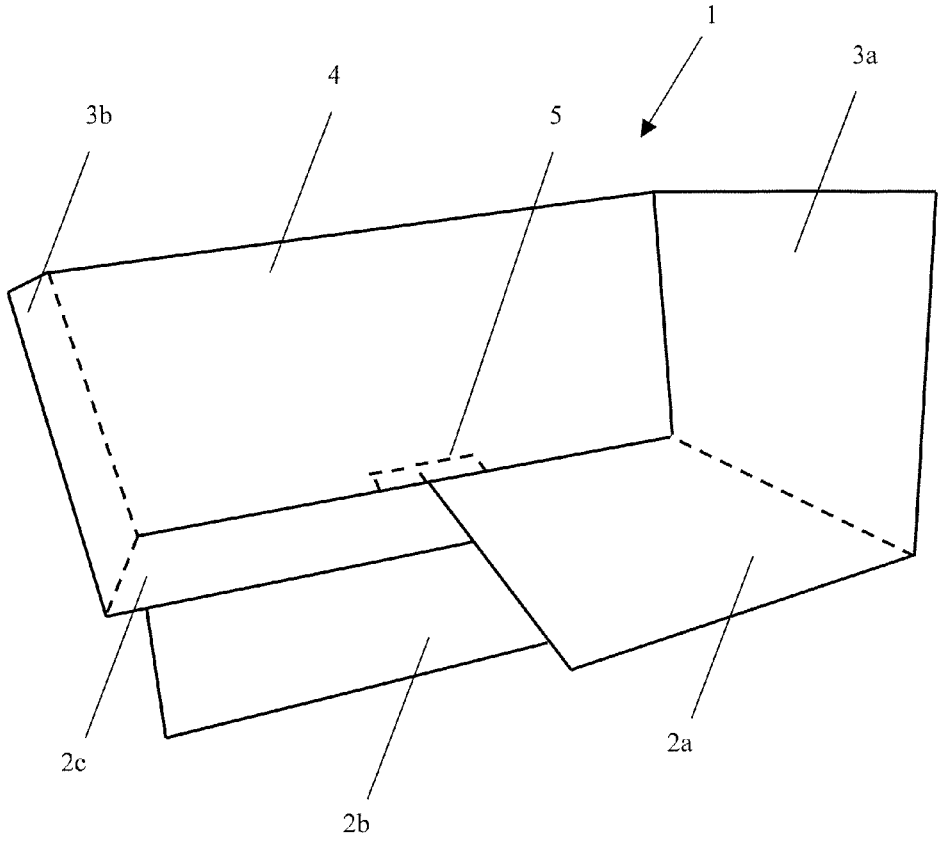
Figure 2C:
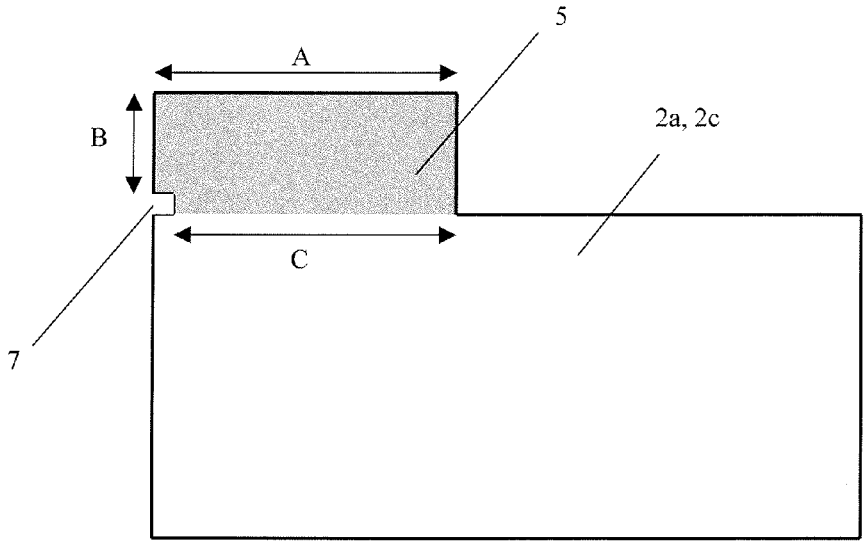
FIG. 2C shows a more detailed view of the tab and notch arrangement of the layers 2*a* and 2*c* according to an embodiment of the present disclosure.

FIGS. 2A and 2B show the assembly of the blank of FIG. 1 in order to form a storage container part 1 according to this example of the present disclosure. In this example, both the layers 2*a* and 2*c* of the base layer 2 are each foldably attached to the opposing side panels 3*a* and 3*b* and each comprise a tab 5. Two corresponding slots 6 are cut into the connecting panel 4 to receive the tabs 5. FIG. 2C shows a more detailed view of the tab and notch arrangement of the layers 2*a* and 2*c* of the base layer 2 according to an embodiment of the present disclosure. The tab has a side of length A, and a notch 7 is cut into the side of length B of the tab 5 perpendicular to side A. The slot 6 has a length substantially the same as that of side C of the tab 5 in order that when the tab 5 is received by the slot 6, the notch 7 forms a locking mechanism to secure the panel 2*a*, 2*c* to the connecting panel 4.

Figure 3A:
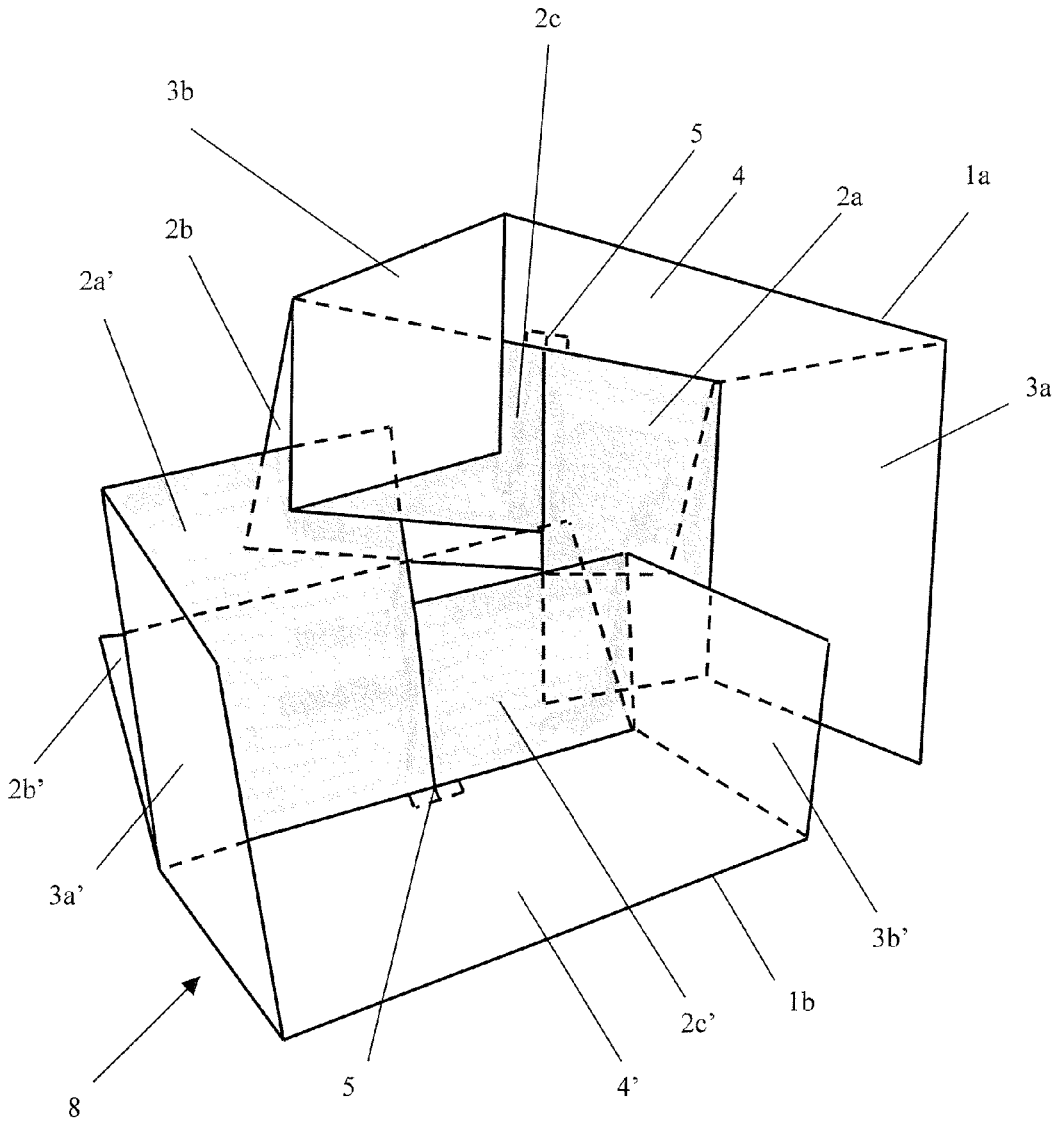
FIGS. 3A and 3B show two assembled parts for forming a bottom section of a storage container according to an embodiment of the present disclosure.
Figure 3B:
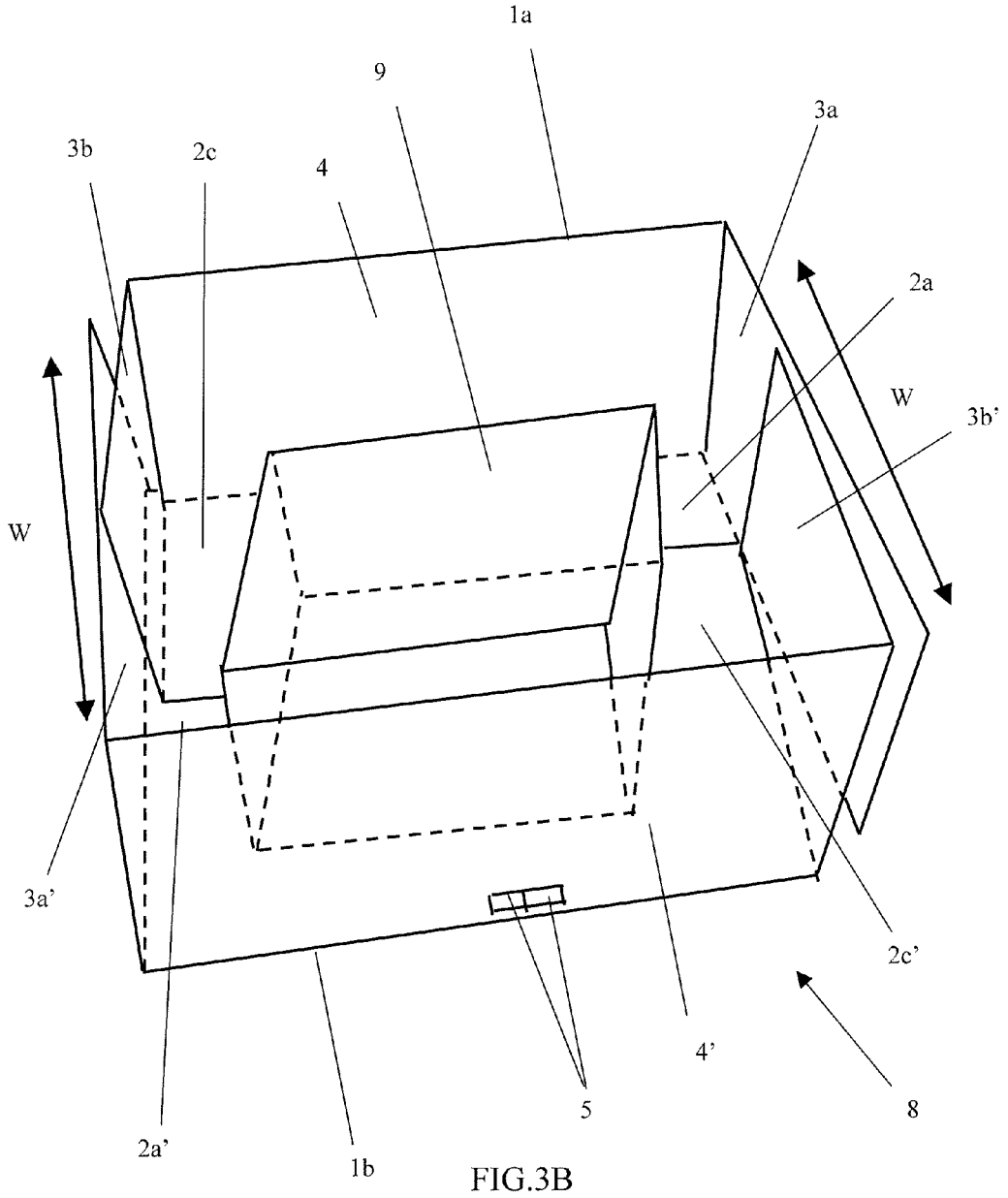

FIGS. 3A and 3B show two assembled parts 1*a* and 1*b* for forming a storage container being arranged, i.e., slotted together, to form a rectangular bottom section 8 according to an embodiment of the present disclosure. As can be seen from the figures, the bottom section 8 comprises a base section (shaded area in FIG. 3A) that is formed from the combined base panels 2*a*, 2*c* and 2*a*,' 2*c*' of the two parts 1*a* and 1*b*. The entire base panel 2 of one part 1*a* may be arranged on top of the entire base panel 2 of the other part 1*b*, but the layers 2*a*, 2*c* and 2*a*', 2*c*' of both parts 1*a* and 1*b* may also be arranged, i.e., slotted together, so that they overlap with one another in any order. In the example according to FIG. 3A, the base panel of each part is L-shaped and the two parts 1*a* and 1*b* are arranged in an opposite configuration to one another such that the L-shaped base panels 2 overlap in order to form a rectangular base surface area with no openings that forms the base of the bottom section 8. FIGS. 3A and 3B also show how the two opposing pairs of side walls 3*a*, 3*b*' and 3*a*', 3*b* and 4 and 4' define an opening in the top of the bottom section 8 and how one of the pairs of opposing side walls 3*a*, 3*b*' and 3*a*', 3*b* are effectively formed from the combined opposing side panels 3*a*, 3*b*' and 3*a*', 3*b* overlapping when the two parts 1*a* and 1*b* are slotted together. The arrows indicate how the two parts 1*a* and 1*b* of the bottom section 8 may be adjusted respective to each other in order to adjust the width W of the bottom section 8 to match the dimensions of the goods 9 stored therein.

Figure 4:
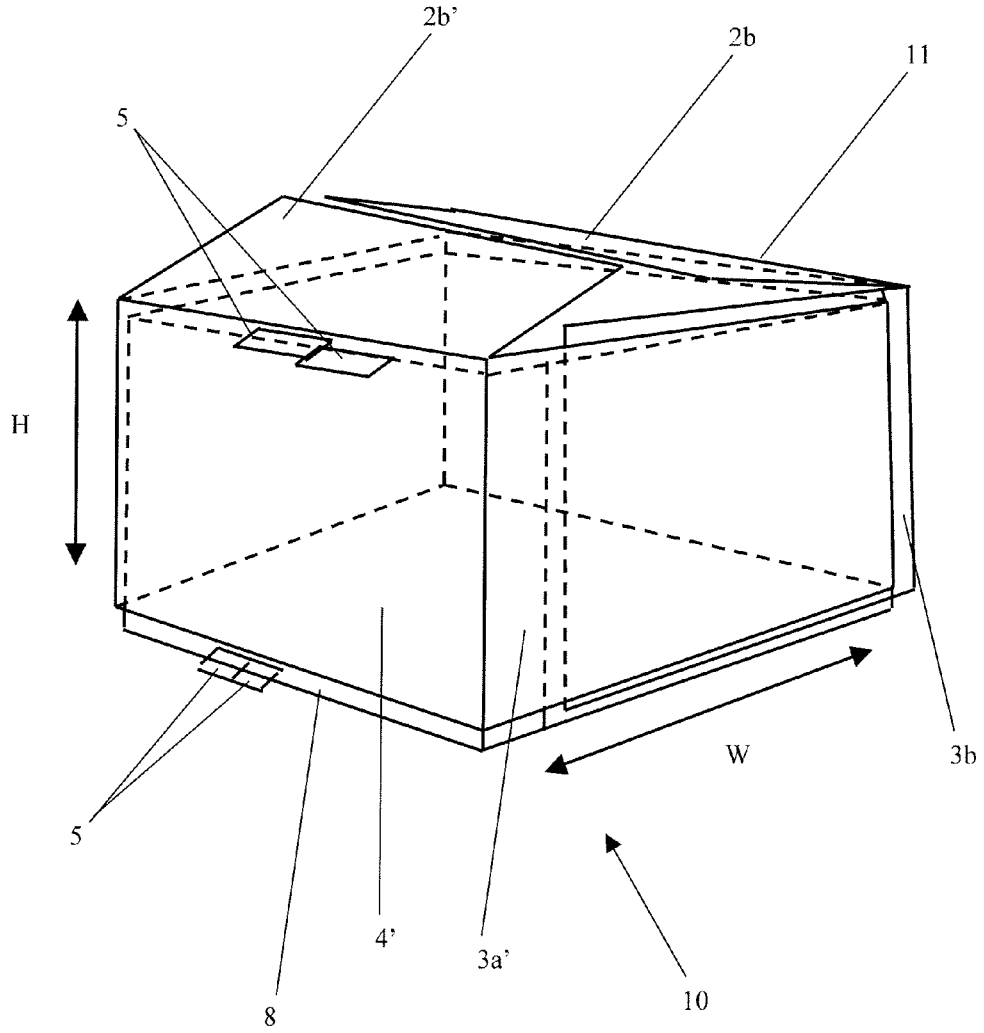
FIG. 4 shows an assembled storage container according to an embodiment of the present disclosure.

FIG. 4 shows an assembled storage container 10 according to an embodiment of the present disclosure. In particular, a top section 11 has been formed through arranging two parts 1*a* and 1*b* in the same manner as described above with respect to forming a bottom section 8 according to FIGS. 1-3. Furthermore, the top section has been mounted, i.e., slotted over the bottom section 8 such that both bottom and top sections 8 and 11 may move telescopically relative to each other in a vertical direction, thereby enabling the adjustment of the height H of the container while the respective two parts 1*a* and 1*b* of each of the bottom and top sections 8 and 11 are also movable in a second dimension, i.e., a horizontal direction W with respect to one another, thereby also allowing the adjustment of width of the storage container 10.

Figure 5:
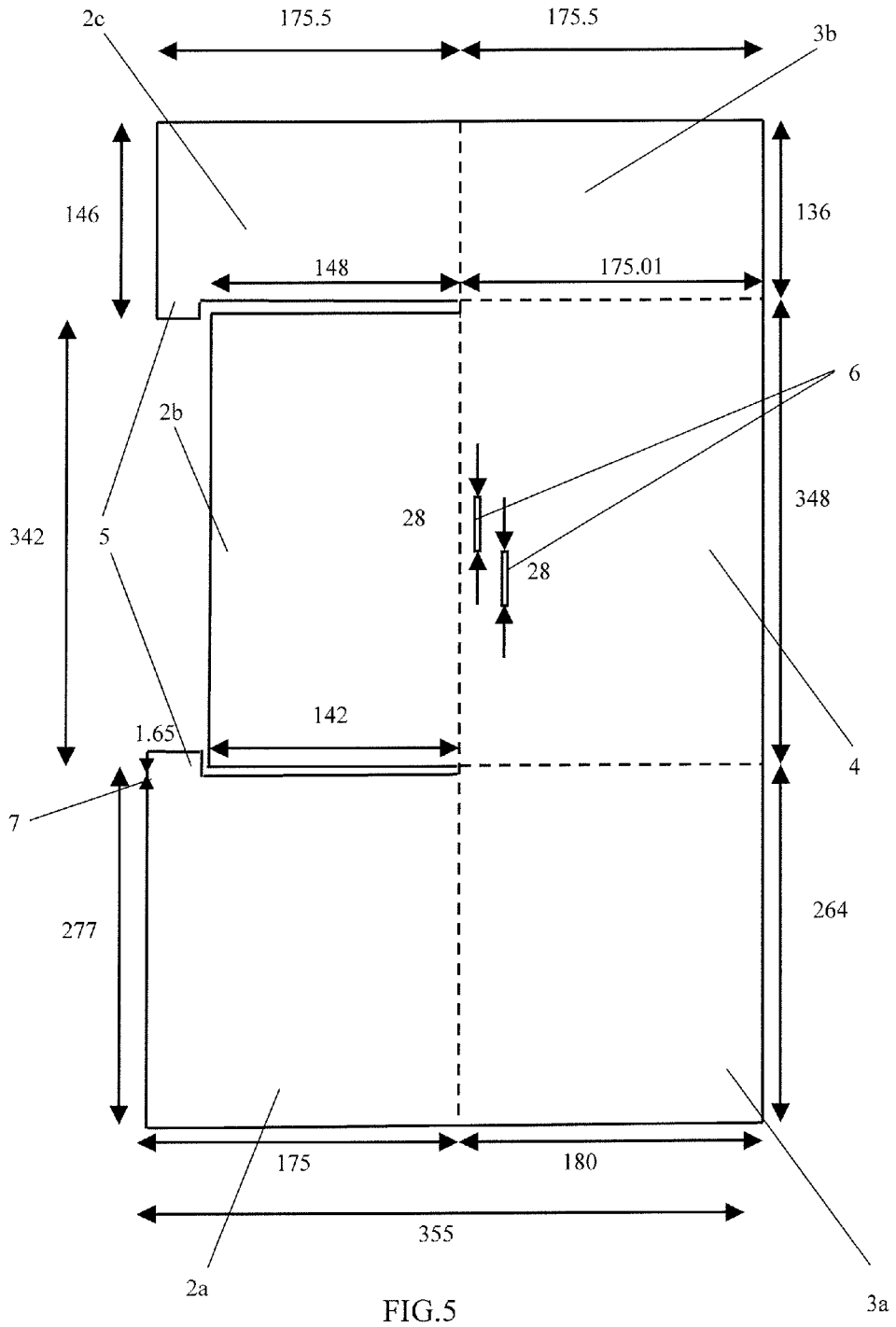
FIG. 5 shows the blank of a part for forming a storage container according to an embodiment of the present disclosure with exemplary dimensions in millimeters (mm).

FIG. 5 shows the blank of a part for forming a storage container according to an embodiment of the present disclosure with exemplary dimensions (shown in mm) for a 34.8 cm wide box. The skilled person will, however, recognize that such a part, according to the present disclosure, may advantageously be produced in a range of different sizes to suit the particular intended use and dimensions 9 of the goods to be stored in a storage container 10 according to the present disclosure.

Once the dimensions of the storage container according to the present disclosure have been adjusted to form the best fit to the dimensions of the goods stored therein, the various panels may be secured together using any known means, e.g., an adhesive, tape, string, etc., before shipping.

The embodiments of the invention in which an exclusive property or privilege is claimed are defined as follows:

1. A rectangular storage container comprising:

four parts releasably coupled to each other, wherein each part comprises a base panel, two opposing panels, and a connecting panel joining the two opposing panels, wherein:

for each part, the two opposing panels are foldably attached to opposing edges of the connecting panel, for each part, the base panel comprises at least two portions, wherein each portion is respectively foldably attached to an edge of one of the two opposing panels, and for at least one part, one of the two opposing panels has a surface area that is smaller than the surface area of the other opposing panel, and one of the at least two portions of the base panel has a surface area that is smaller than the surface area of the other portion of the base panel, wherein two of the parts are arranged to form a bottom section comprising a base section and two opposing pairs of side walls defining an opening, wherein two of the parts are arranged to form a top section comprising a lid section and two opposing pairs of side walls defining an opening, wherein the bottom section and top section can move telescopically with respect to each other in a first dimension, and wherein the respective two parts forming the bottom section and top section can move with respect to each another in a second dimension to enable adjustment of the volume of the storage container in both the first and second dimensions.

2. The storage container of claim 1, wherein each part is formed from a sheet of material.

3. The storage container of claim 1, wherein the first dimension is the height and the second dimension is the width of the storage container.

4. The storage container of claim 1, wherein a minimum width of the storage container corresponds to a maximum width of one of the two opposing panels of a part, and a maximum width of the storage container corresponds to a combined width of the two opposing panels, each of the two opposing panels of a different one of the two parts arranged to respectively form the bottom or top section.

5. The storage container of claim 1, wherein a minimum height of the storage container corresponds to a maximum height of the two opposing panels or connecting panel, and the maximum height of the storage container corresponds to at least 150% of the minimum height.

6. The storage container of claim 1, wherein at least one of the portions of the base panel comprises a protruding tab with a notch and one of the two opposing panels or the connecting panel comprises at least one slit to receive the tab.

7. The storage container of claim 1, wherein for the at least one part, the surface area of one opposing panel is not less than 50% smaller than the surface area of the other opposing panel.

8. The storage container of claim 1, wherein the base and/or lid sections comprise at least two layers of material.

9. The storage container of claim 1, wherein all four parts have substantially the same dimensions.

10. The storage container of claim 1, wherein at least one of the parts has different dimensions to the dimensions of the other parts.

11. A storage container part comprising a base panel, two opposing panels, and a connecting panel joining the two opposing panels as claimed in claim 1, wherein the storage container part can be releasably coupled with three substantially identical other storage container parts to form a rectangular storage container as claimed in claim 1.

12. A blank of sheet material comprising one or more portions shaped to form a storage container or storage container part as claimed in claim 1.

13. A rectangular storage container comprising:

four parts releasably coupled to each other, wherein each part comprises a base panel, two opposing panels, and a connecting panel that joins the two opposing panels, wherein:

for each part, the two opposing panels are foldably attached to opposing edges of the connecting panel, and for each part, the base panel comprises at least two portions, wherein one of the at least two portions is foldably attached to an edge of one of the two opposing panels and the other of the at least two portions is foldably attached to an edge of the other of the two opposing panels, wherein, for at least one of the four parts, each of the two opposing panels has a length and a width, and the length or width of one of the opposing panels is smaller than the respective length or width of the other opposing panel, and each of the at least two portions of the base panel has a length and a width, and the length or width of one of the portions of the base panel is smaller than the respective length or width of the other portion of the base panel, wherein two of the parts are arranged to form a bottom section comprising a base section and two opposing pairs of side walls defining an opening, wherein two of the parts are arranged to form a top section comprising a lid section and two opposing pairs of side walls defining an opening, wherein the bottom section and top section telescopically move with respect to each other in a first dimension, and the respective two parts forming the bottom section and the respective two parts forming the top section move with respect to each another in a second dimension, enabling adjustment of the volume of the storage container in both the first and second dimensions.

14. The storage container of claim 13, wherein each of the four parts is comprised of a single sheet of material.

15. The storage container of claim 13, wherein the storage container has a minimum width that corresponds to a maximum width of one of the two opposing panels of a part, and wherein the storage container has a maximum width that corresponds to the combined width of two opposing panels.

16. The storage container of claim 13, wherein the storage container has a minimum height that corresponds to a maximum height of the two opposing panels or connecting panel, and wherein the storage container has a maximum height that corresponds to at least 150% of the minimum height.

17. The storage container of claim 13, wherein at least one of the at least two portions of the base panel includes a protruding tab with a notch and one of the two opposing panels or the connecting panel includes a slit that receives the protruding tab.

18. The storage container of claim 13, wherein the length or width of one of the opposing panels is not less than 50% smaller than the respective length or width of the other opposing panel.

19. The storage container of claim 13, wherein the base section and/or the lid section comprise at least two layers of material.

20. The storage container of claim 13, wherein all four parts have substantially the same dimensions.

* * * * *